US007032851B2

(12) United States Patent
Demske et al.

(10) Patent No.: US 7,032,851 B2
(45) Date of Patent: Apr. 25, 2006

(54) PORTABLE PILL CRUSHING DEVICE

(75) Inventors: John F. Demske, 469 Echo Rd., Vestal, NY (US) 13850; Caleob King, Lawrence, KS (US)

(73) Assignee: John F. Demske, Vestal, NY (US)

( * ) Notice: Subject to any disclaimer, the term of this patent is extended or adjusted under 35 U.S.C. 154(b) by 0 days.

(21) Appl. No.: 10/735,386

(22) Filed: Dec. 12, 2003

(65) Prior Publication Data

US 2005/0127218 A1 Jun. 16, 2005

(51) Int. Cl.
*B02C 1/08* (2006.01)

(52) U.S. Cl. ..... 241/221; 241/DIG. 27

(58) Field of Classification Search ..... 241/DIG. 27, 241/221, 169.1, 285.1
See application file for complete search history.

(56) References Cited

U.S. PATENT DOCUMENTS

| | | | | |
|---|---|---|---|---|
| 2,506,848 | A * | 5/1950 | Turner | 99/569 |
| 3,077,309 | A * | 2/1963 | Kocher | 241/221 |
| 3,960,335 | A * | 6/1976 | Haberle | 241/236 |
| 4,022,073 | A * | 5/1977 | Sendzimir | 74/410 |
| 4,121,775 | A | 10/1978 | Rosenberg et al. | |
| 5,067,666 | A | 11/1991 | Sussman | |
| 5,148,995 | A * | 9/1992 | Hurst | 241/30 |
| 5,322,227 | A | 6/1994 | Fiocchi | |
| 5,531,386 | A * | 7/1996 | Jensen | 241/36 |
| 5,863,001 | A * | 1/1999 | Schulze | 241/30 |
| 5,915,637 | A * | 6/1999 | Parsons | 241/168 |
| 6,059,209 | A | 5/2000 | Barson | |
| 6,113,016 | A | 9/2000 | Vedefors | |
| 6,508,424 | B1 * | 1/2003 | Marshall | 241/169.1 |
| 6,523,766 | B1 | 2/2003 | Watt | |
| 6,637,685 | B1 * | 10/2003 | Kruger | 241/169.1 |

* cited by examiner

*Primary Examiner*—Faye Francis
(74) *Attorney, Agent, or Firm*—Dale J. Ream

(57) ABSTRACT

A portable pill crushing device includes a housing having a base, a motor disposed in the housing, a battery for supplying electrical power to the motor, and a series of rotatably mounted rollers connected to the motor. A pressure plate is attached to the housing and is movable between a closed position in which a crushing chamber is defined between a first surface of the pressure plate and the outer surfaces of the rollers, and an open position in which the pressure plate can be used to provide a manual pre-crushing operation to reduce large pills to an acceptable size range. The housing has a vacuum lock system in its base for anchoring the crushing device to a smooth surface. Plastic enclosures are provided for encasing the pills to prevent direct contact of the pills with the rollers and the pressure plate to avoid contamination.

18 Claims, 5 Drawing Sheets

PORTABLE PILL CRUSHING DEVICE

BACKGROUND OF THE INVENTION

1. Field of the Invention

The present invention relates generally to devices used to crush and pulverize small objects into fine powder. In particular, the present invention relates to a portable, battery-operated pill crushing device having a series of rollers that operate to crush and pulverize pills into a fine powder.

2. Description of the Related Art

As our population ages, larger and larger proportions of adults depend on daily medication for their health and well being. The range of ailments treatable today with only a pill is staggering, but the shear number of pills that must be taken has grown similarly large. However, some patients cannot swallow or have difficulty swallowing pills. Such patients often take their medication crushed—mixed in with food or drink. Whether at home or in a managed care situation, the job of crushing the medication is often tedious and difficult.

In the past, a traditional mortar and pestle have been used to manually crush the pill into a fine powder, which is then stored in a medicine cup until it is administered to the patient. The use of a mortar and pestle, however, has several problems. For example, the mortar and pestle must be thoroughly cleaned after each use to prevent the matter with which it is next used from becoming contaminated with the residue from the last substance with which it was used. The crushed powder adhering to the mortar or the pestle can reduce the ultimate dosage transferred to the patient resulting in sub-standard treatment. Moreover, since the mortar and pestle are operated manually by each care provider, it is difficult to achieve consistent particle sizes from the crushed pills.

Manual and motor-driven devices have been proposed in the past to overcome these problems. For example, U.S. Pat. No. 5,067,666 (Sussman) discloses a portable pill crusher that uses a cam-driven, spring-biased ram to pulverize a pill. U.S. Pat. No. 4,121,775 (Roseberg et al.) discloses a pulverizer that includes a pestle movable into a bowl. U.S. Pat. No. 6,059,209 (Barson) discloses a manually operated apparatus for crushing tablets into powders using a pivotable hammer and a press for applying pressure to the hammer. U.S. Pat. No. 6,523,766 (Watt) discloses a portable pill crushing device that uses a mallet attached to a thrust arm to pulverize pills, and includes a plastic bag and sealing apparatus for encasing the pills in plastic during the crushing operation. U.S. Pat. No. 5,531,386 (Jensen) discloses a pill pulverizing apparatus that uses a hammer and spring to crush pills contained in a plastic envelope. However, none of these prior art devices provide pill crushing devices that adequately accommodate the needs of patients having difficulty swallowing pills and those administering medications to such patients.

SUMMARY OF THE INVENTION

An object of the present invention is to provide an improved pill crushing device that solves the problems in the existing devices described above.

More specifically, it is an object of the present invention to provide a pill crushing device that is easy to inspect and clean, that allows pills to remain encased in plastic to avoid contamination, and that allows pre-crushing to reduce large pills to a size that will pass through the device.

It is a further object of the present invention to provide a pill crushing device that is dependable in operation, is capable of a long operating life, is inexpensive to manufacture, is easy to use and maintain, and that is particularly suitable for use in crushing a variety of pill sizes.

It is a further object of the present invention to provide a battery-powered pill crushing device that uses a roller mill-type arrangement of rollers to crush pills, and that uses a pressure plate in conjunction with the rollers to form the crushing chamber and to provide a manual pre-crushing operation.

In order to accomplish these and other objects of the invention, a portable pill crushing device is provided for pulverizing pills into powder that can be mixed in with food or drink for persons having swallowing difficulties. The pill crushing device includes a housing having a base, a motor disposed in the housing, a battery for supplying electrical power to the motor, and a series of rotatably mounted rollers connected to the motor. A pressure plate is attached to the housing and has a closed position in which a crushing chamber is defined between a first surface of the pressure plate and the outer surfaces of the rollers. The pressure plate is rotatable from its closed position to an open position in which the pressure plate can be used to provide a manual pre-crushing operation to reduce large pills to an acceptable size range for passing through the crushing chamber. The housing has a vacuum lock system in its base for anchoring the crushing device to a smooth surface during operation. Plastic enclosures are provided for encasing the pills to prevent direct contact of the pills with the rollers and the pressure plate to avoid contamination.

According to a broad aspect of the present invention, a portable pill crushing device is provided, comprising: a housing; a motor disposed in the housing; at least one roller rotatably mounted within the housing and drivingly connected to the motor, the roller having an outer surface for engaging and crushing pills; and a pressure plate attached to the housing. The pressure plate has a first position in which a first surface of the pressure plate is disposed adjacent to the outer surface of the roller, whereby pills can be crushed between the pressure plate and the roller as the roller is rotatably driven by the motor.

According to another broad aspect of the present invention, a portable pill crushing device is provided, comprising: a housing having a base for supporting the pill crushing device in an upright position; a motor disposed in the housing; a battery removably attached to the housing for supplying electrical power to the motor; and a series of rollers rotatably mounted within the housing and drivingly connected to the motor. The rollers each have a smooth outer surface for engaging and crushing pills.

According to yet another aspect of the present invention, a method of crushing pills is provided, comprising the step of providing a portable pill crushing device having a housing, a motor disposed in the housing, a series of rollers rotatably mounted within the housing and drivingly connected to the motor, and a pressure plate attached to the housing. The method further comprises the steps of: placing a pill to be crushed into an inlet of the housing; and crushing the pill by energizing the motor to rotate the series of rollers and causing the pill to pass between the pressure plate and respective outer surfaces of the rollers.

Numerous other objects of the present invention will be apparent to those skilled in this art from the following description wherein there is shown and described a preferred embodiment of the present invention, simply by way of illustration of some of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

Figure 1:
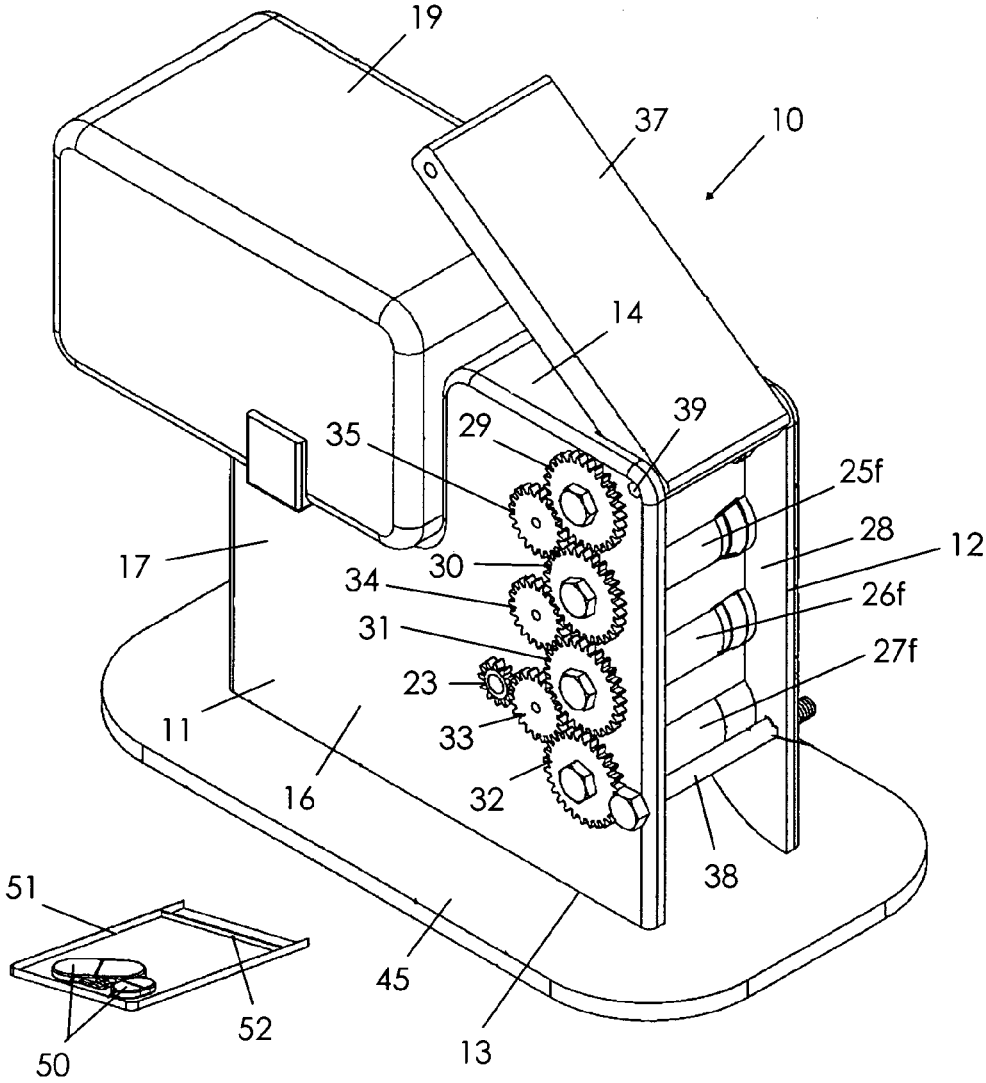
FIG. 1 is a perspective view of a portable pill crushing device according a preferred embodiment of the present invention.
Figure 2:
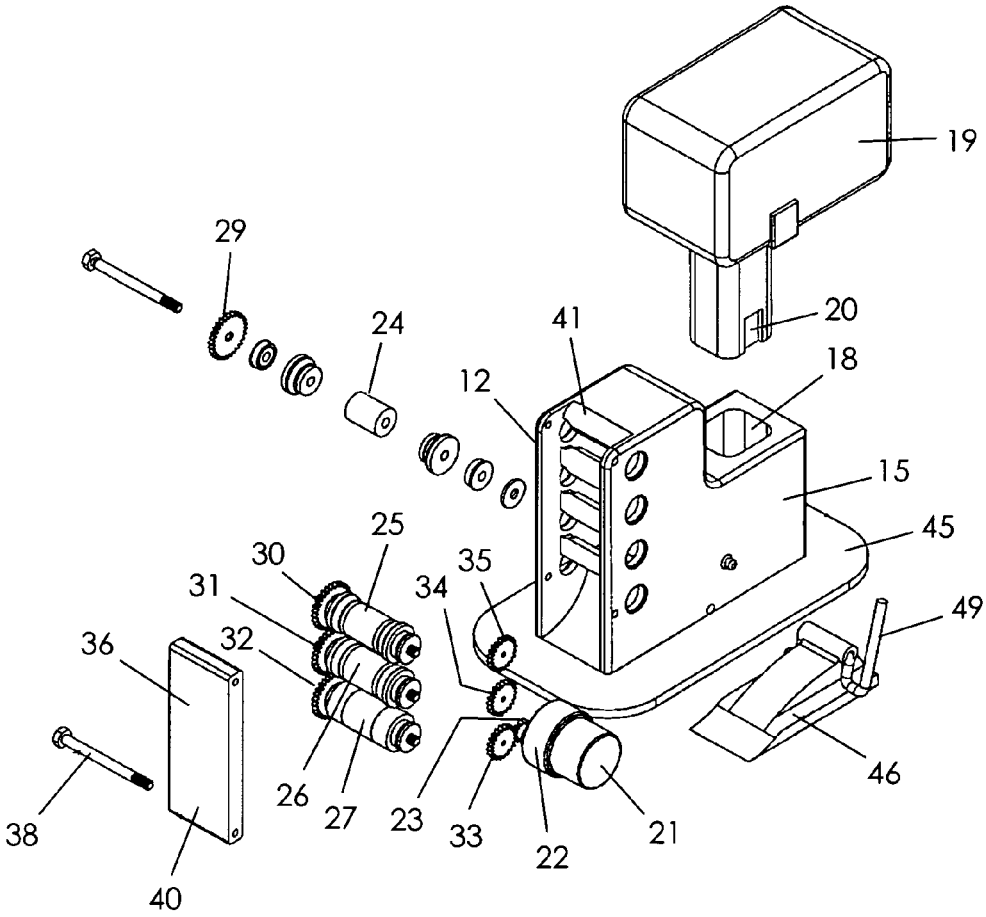
FIG. 2 is an exploded perspective view of the portable pill crushing device of the present invention.

A portable pill crushing device 10 according to a preferred embodiment of the present invention will now be described in detail with reference to FIGS. 1 to 5*b* of the drawings.

The pill crushing device 10 includes a housing 11 having a front side 12, a bottom side 13, a top side 14, and right and left sides 15 and 16. The housing 11 can be made of any suitable material, such as molded plastic, metal or the like. The housing 11 can be formed as a single integral member, or as an assembly of individual components attached together by threaded fasteners, adhesive, or other suitable means.

A rear portion 17 of the housing 11 has a receptacle 18 formed therein for receiving a rechargeable battery 19. Electrical conductors (not shown) are exposed in the receptacle 18 for connecting to the corresponding conductor posts 20 of the battery 19. The battery 19 can be a conventional battery (e.g., 9 to 24 volts) such as those commonly used in cordless drills and other power tools. The battery 19 preferably has enough energy storage to operate a motor for a significant length of time, is rechargeable, can handle deep cycle use (repeated draining and charging), and can be exchanged quickly and easily with a fresh battery when needed. The battery 19 can be removed from the receptacle 18 and connected to a battery charger (not shown) for recharging in a well-known manner. The rear portion 17 of the housing 11 defines a stepped configuration to accommodate the shape of the battery 19 and to minimize the overall size of the crushing device 10.

A battery-powered electric motor 21 is disposed in the housing 11 for powering the device 10. The motor 21 is electrically connected to the battery 19 by suitable electrical wires (not shown). The motor 21 is preferably a "gear-head" type DC motor having an integral gearbox 22 to reduce the speed and increase the torque of the output. The output of the motor 21 is connected to a motor gear 23 and preferably operates at a relatively low speed and high torque.

A series of rollers 24–27 having smooth outer surfaces are rotatably mounted within the housing 11. The rollers 24–27 are pivotally mounted at their respective ends to the right and left sides 15 and 16 of the housing 11. Each roller 24–27 has a front portion 24*f*–27*f* exposed in a crushing chamber 28 formed in a front part of the housing 11.

Drive gears 29–32 are connected to the rollers 24–27 and are disposed either within or outside the housing 11. A plurality of idler gears 33–35 are interconnected with the drive gears 29–32 so that the rollers 24–27 are all driven simultaneously and at substantially the same speed. One of the idler gears 33 is connected to the motor gear 23 at the output of the motor 21. The motor gear 23, idler gears 33–35, and drive gears 29–32 together form a gear train that transmits the rotational driving force of the motor 21 to the rollers 24–27. Other suitable drive arrangements are also possible, such as a series of pulleys and a toothed belt, or a series of sprockets and a chain, or a combination of such drive arrangements.

Figure 3A:
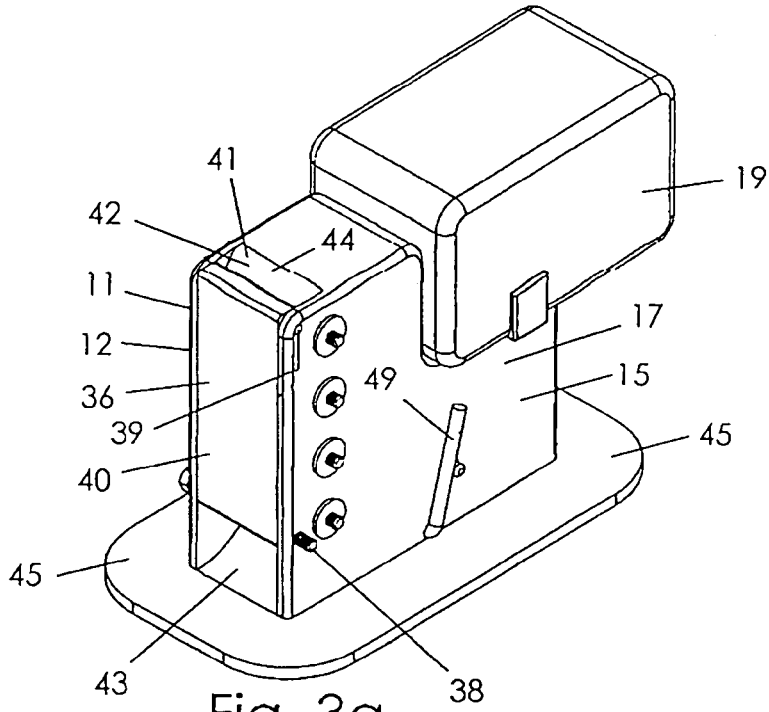
FIG. 3*a* is a perspective view of the portable pill crushing device with the pressure plate shown in a closed position.

A pressure plate 36 is removably and pivotally attached to the front side 12 of the housing 11. The pressure plate 36 is preferably formed of stainless steel and has a first smooth surface 37 on a side facing the rollers 24–27. The pressure plate 36 is attached by a first removable pin 38 near the lower part of the front side 12 of the housing 11, and by a second pin 39 near the upper part of the housing 11. The pressure plate 36 is arranged to pivot freely about the axis of the second pin 39 when the first pin 38 is removed. The pressure plate 36 has a first closed position, as shown in FIG. 3*a*, in which the first and second pins 38, 39 secure the pressure plate 36 in a fixed position with the pressure plate 36 arranged to substantially cover the front side 12 of the housing 11. When the first pin 38 is removed, the pressure plate 36 is rotatable about the axis of the second pin 39 and displaced away from the front portions 24*f*–27*f* of the rollers 24–27 until a second side 40 of the pressure plate 36 is in close proximity to an upper surface 41 on the top side 14 of the housing 11 (e.g., about 210 degrees of rotation). The purpose of this rotational movement of the pressure plate 36 will be explained below.

The crushing chamber 28 of the device 10 is defined between the first smooth surface 37 of the pressure plate 36 and the exposed front portions 24*f*–27*f* of the rollers 24–27, when the pressure plate 36 is secured in its first position. The first surface 37 of the pressure plate 36 is disposed adjacent to the exposed front portions 24*f*–27*f* of the rollers with a controlled spacing therebetween. The roller 24 closest to the inlet 42 of the crushing device 10 has a wider spacing than the roller 27 closest to the outlet 43 of the crushing device 10 to provide a progression of crushing action from a coarse starting material to a relatively fine crushed material. If a series of rollers 24–27 are used, as in the preferred embodiment shown in the drawings, the rollers 24–27 are spaced from the pressure plate 36 with a gradual change from a relatively wide spacing near the inlet 42 to a relatively close spacing near the outlet 43 to provide a gradual progression of crushing action from coarse material to fine material.

Figure 3B:
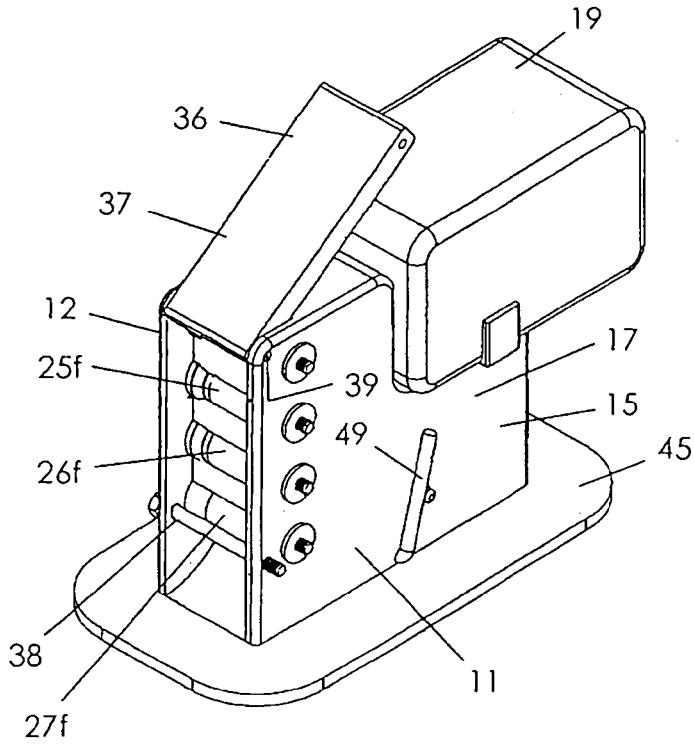
FIG. 3*b* is a perspective view of the portable pill crushing device with the pressure plate shown in an open position.
Figure 4A:
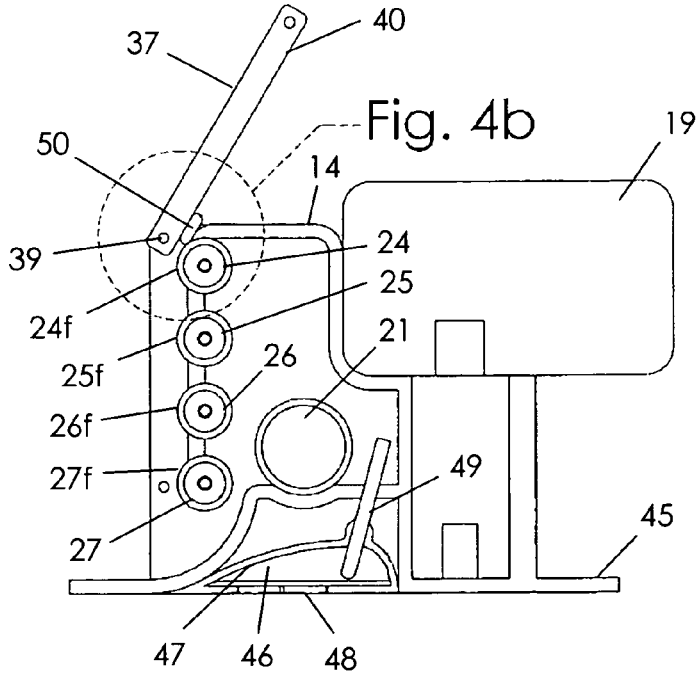
FIG. 4*a* is a cross-section side view of the portable pill crushing device with the pressure plate shown in an open position and being used to perform a pre-crushing operation.
Figure 4B:
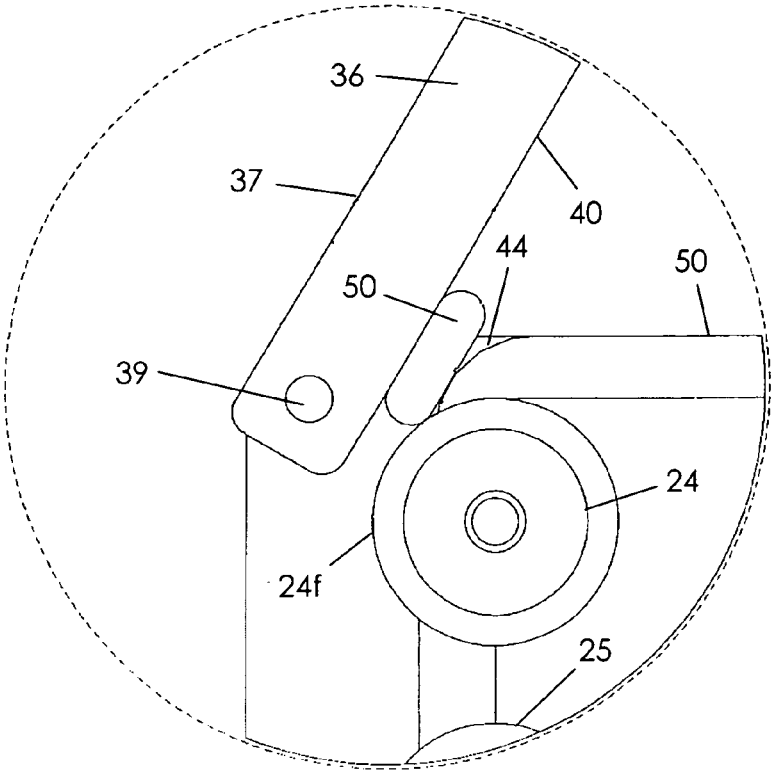
FIG. 4*b* is an enlarged detail view of the area indicated by the dashed line circle in FIG. 4*a;*

The pressure plate 36 provides a pre-crushing function when the first lower pin 38 is removed and the pressure plate 36 is rotated into the position shown in FIGS. 1 and 3*b*. As shown, for example, in FIGS. 2 and 4*b*, the top side 14 of the housing 11 has a sloped surface 44 near the inlet 42. The sloped surface 44 normally functions to guide the pills to be crushed into the crushing chamber 28 when the pressure plate 36 is in its first position. However, the sloped surface 44 also functions as an opposing surface for the pre-crushing operation. By placing large pills to be crushed between the second side 40 of the pressure plate 36 and the sloped surface 44, and then manually moving the pressure plate 36 toward the sloped surface 44, the large pills can be squeezed and crushed into smaller sized particles that fit through the inlet 42 and pass through the crushing chamber 28. After the pre-crushing operation is completed, the pressure plate 36 is moved back into its first closed position and secured in place by the first pin 38.

Figure 5A:
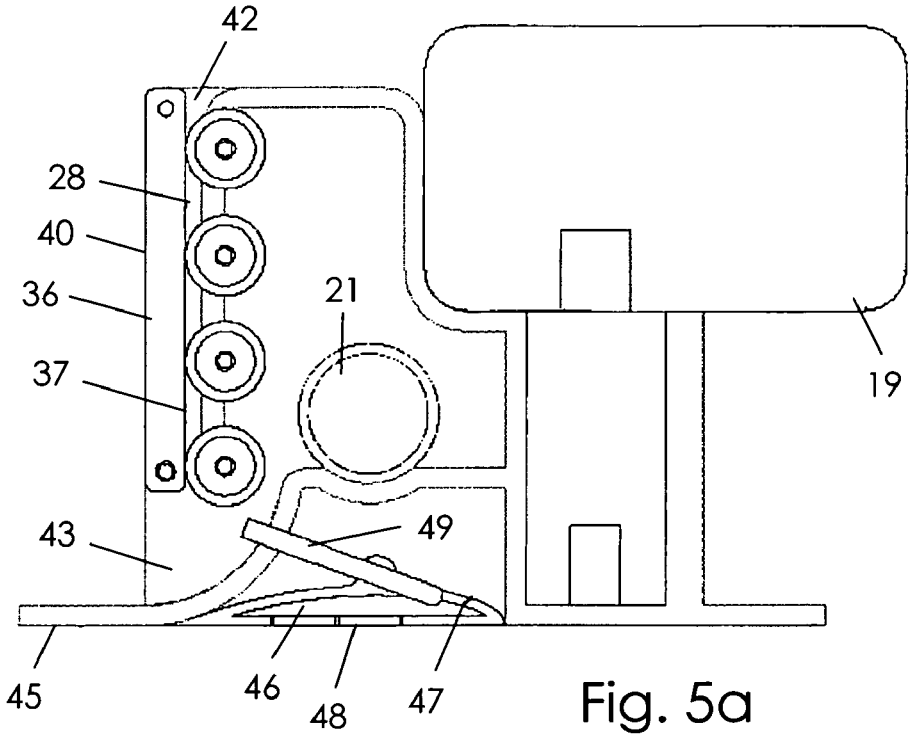
FIG. 5*a* is a cross-section side view of the portable pill crushing device with the vacuum lock system in the base of the housing shown in a loose position.

The housing 11 has a base 45 for stabilizing the crushing device 10 during use. The base 45 provides a larger footprint for the device 10 and helps prevent the device 10 from tipping during use. A vacuum lock system 46 is provided to further stabilize the device 10 during use. The vacuum lock system 46 includes a flexible bladder 47 having an opening 48 on a bottom side that rests on a smooth surface (not shown) of a table, med-cart, or the like. A lever actuator 49 is provided for moving the bladder 47 between a first loose position, as shown in FIG. 5*a*, and a second anchored position, as shown in FIG. 5*b*.

Figure 5B:
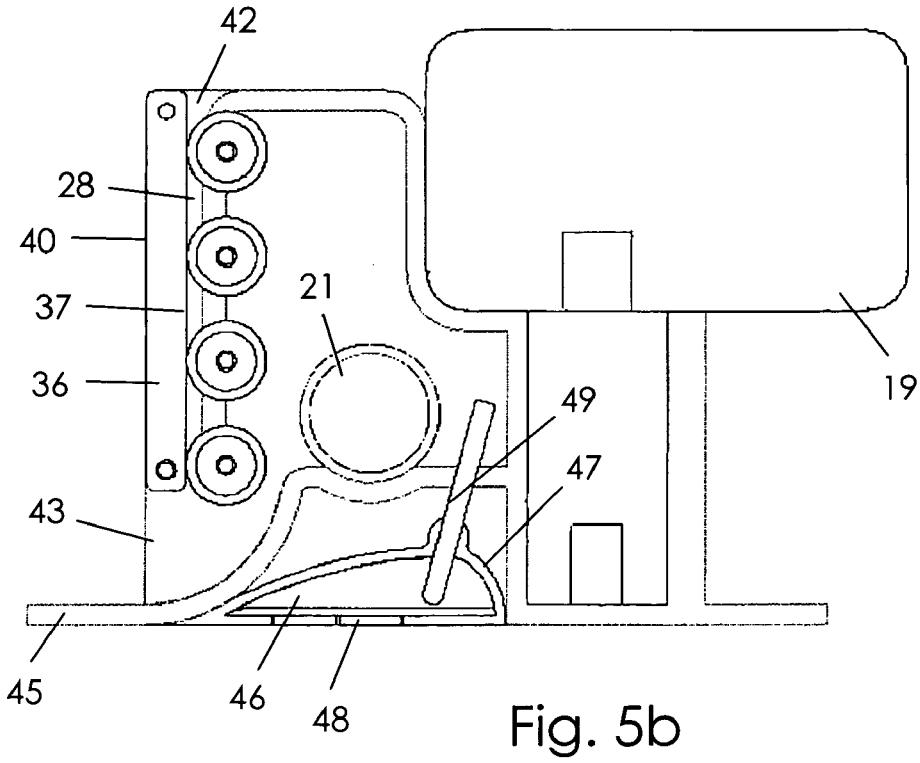
FIG. 5*b* is a cross-section side view of the portable pill crushing device with the vacuum lock system shown in an anchored condition.

In the second anchored position shown in FIG. 5*b*, a vacuum is created by the bladder 47 between the base 45 and the smooth surface, thereby causing the device 10 to be securely anchored to the smooth surface. By moving the lever actuator 49 back to its first loose position shown in FIG. 5*a*, the vacuum is removed and the device 10 can be repositioned or removed from the smooth surface as desired. The vacuum lock system 46 combined with the relatively large footprint of the base provides a very stable arrangement that resists tipping even when a large force is applied to the device 10. This is particularly important when the pressure plate 36 is being used to provide a manual pre-crushing operation.

Using smooth stainless steel rollers 24–27 and a stainless steel pressure plate 36, very little medication is retained in the crushing device 10 following use of the present invention. However, considering the extreme potency of some medication, extra precautions should be taken to insure that no cross contamination occurs. Accordingly, the pills 50 to be crushed by the crushing device 10 are preferably encased in a closed plastic bag 51 during the pre-crushing and crushing operations. The plastic bags 51 for this purpose are preferably made of heavy plastic (e.g., 4 to 6 mil thickness) to prevent the rupture of the plastic bag 51 during use. The plastic bags 51 are sealed closed using a conventional closing mechanism 52, such as a ZIPLOCK™-type closure. The rollers 24–27 of the crushing device 10 grip the plastic bags 51 and cause the closed bags 51 to be sent through the crushing chamber 28 with the still-enclosed powdered medication from the pills 50 being fed out the outlet 43 at the bottom of the device 10. In the case of a break or tear in the plastic, the crushing device 10 can be opened, inspected, and cleaned easily by pivoting the pressure plate 36 into its open position.

In operation, the portable pill crushing device 10 of the present invention can be used to crush large pills 50 easily and effectively and without contamination. The device 10 is first positioned on a smooth surface, such as a table or med-cart. The vacuum lock system 46 is then actuated by moving the lever actuator 49 into its anchored position, causing the base 45 to be anchored firmly to the smooth surface.

The pills 50 to be crushed are encased in a sealed, plastic bag 51. If the pills are too large to fit into the inlet 42 of the crushing chamber 28, the pressure plate 36 is unlocked from its closed position by removing the first lower pin 38 and pivoted into its open position. The encased pills 50 are then placed between the pressure plate 36 and the sloped surface 44 at the inlet 42 of the housing 11. A manual pre-crushing force is then exerted on the pressure plate 36 causing the pills 50 to be squeezed and crushed between the pressure plate 36 and the housing 11. Once an adequate amount of pre-crushing has been completed, the pressure plate 36 is pivoted back into its first position and secured in place at its lower end by replacing the first lower pin 38.

The motor 21 of the device 10 is then energized using a suitable switch (not shown) to cause the rollers 24–27 to be rotatably driven. With the rollers 24–27 rotating, the encased, pre-crushed pills 50 are introduced into the crushing chamber 28 through the inlet 42 at the top side 14 of the housing 11. The outer surface of the first roller 24 closest to the inlet 42 engages the plastic bag 51 containing the pills 50 and draws the plastic bag 51 down into the crushing chamber 28. The pills 50 are then crushed between the first roller 24 and the pressure plate 36, and then between the second roller 25 and the pressure plate 36, and so on until the pills 50 pass between the last roller 27 and the pressure plate 36, at which point the plastic bag 51 containing the powdered pills 50 exits the outlet 43 at the lower end of the device 10. The crushed pills 50 can then be removed from the plastic bag 51 and used for their intended purpose.

It will be understood by those skilled in the art that the term "pills" as used in this application includes medicated and non-medicated pills, tablets, pellets, and other substances capable of being pulverized into powder.

While the invention has been specifically described in connection with specific embodiments thereof, it is to be understood that this is by way of illustration and not of limitation, and the scope of the appended claims should be construed as broadly as the prior art will permit.

Having thus described the invention, what is claimed as new and desired to be secured by Letters Patent is as follows:

1. A portable pill crushing device, comprising:

a housing;

a motor disposed in said housing;

a series of rollers rotatably mounted within the housing and drivingly connected to said motor, said series of rollers each having a smooth outer surface outer surface for engaging and crushing pills;

a pressure plate attached to the housing, said pressure plate having a first position in which a first surface of the pressure plate is disposed adjacent to the respective outer surfaces of said series of rollers for crushing pills as the pills pass between the first surface of the pressure plate and the outer surfaces of said series of rollers as said series of rollers are rotatably driven by the motor.

2. The portable pill crushing device according to claim 1, wherein said pressure plate is rotatably connected to the housing such that the pressure plate can be rotated away from the roller for inspection and cleaning.

3. The portable pill crushing device according to claim 1, wherein said pressure plate is rotatable about a first axis away from said first position and into close proximity to an outer surface of the housing for engaging and crushing pills between the pressure plate and the outer surface of the housing in a manual pre-crushing operation.

4. The portable pill crushing device according to claim 1, wherein said pressure plate is rotatable about a first axis away from said first position such that the first surface of the pressure plate moves away from the outer surfaces of said series of rollers and a second surface of the pressure plate moves into close proximity to a top side of the housing, whereby said pressure plate cooperates with said housing to provide a manual pre-crushing operation.

5. The portable pill crushing device according to claim 4, wherein an upper surface of the housing comprises a sloped surface that directs pills to be crushed into a space between the pressure plate and said series of rollers.

6. The portable pill crushing device according to claim 5, wherein said second surface of the pressure plate is movable into close proximity to said sloped surface to provide the manual pre-crushing operation.

7. The portable pill crushing device according to claim 1, wherein said housing has a base for stabilizing the crushing device during use.

8. The portable pill crushing device according to claim 7, wherein said base has a vacuum lock system operable to anchor the crushing device to a smooth surface using a vacuum created between the base and the smooth surface.

9. The portable pill crushing device according to claim 1, wherein said series of rollers include includes a first roller closest to an inlet of the crushing device and a last roller closest to an outlet of the crushing device, and a spacing between said pressure plate and the respective outer surfaces of the rollers decreases from the first roller to the last roller to provide a gradual progression of crushing from coarse material to fine material.

10. The portable pill crushing device according to claim 1, wherein said motor is connected to said series of rollers by a gear train.

11. The portable pill crushing device according to claim 1, wherein said housing comprises a receptacle formed therein for receiving a rechargeable battery for supplying power to the motor.

12. The portable pill crushing device according to claim 1, wherein said housing comprises a front side, a bottom side, a top side, and right and left sides, said series of rollers are pivotally mounted at their respective ends to the right and left sides of the housing, the pressure plate is arranged to substantially cover the front side, an inlet of a crushing chamber is provided between the top side and an upper end of the pressure plate, and an outlet of the crushing chamber is provided between the bottom side and a lower end of the pressure plate.

13. The portable pill crushing device according to claim 1, wherein said series of rollers comprises a plurality of rollers which are made of stainless steel and have smooth outer surfaces.

14. The portable pill crushing device according to claim 1, further comprising a plastic enclosure for encasing a pill during crushing to prevent contamination.

15. A portable pill crushing device, comprising:

a housing having a base for supporting the pill crushing device in an upright position;

a motor disposed in said housing;

a battery removably attached to said housing for supplying electrical power to said motor;

a series of rollers rotatably mounted within the housing and drivingly connected to said motor, said rollers each having a smooth outer surface for engaging and crushing pills; and a pressure plate attached to the housing, said pressure plate being movable between a closed position in which a first surface of the pressure plate is disposed adjacent to the outer surfaces of the rollers, and an open position in which the pressure plate is displaced away from the outer surfaces of the rollers to facilitate inspecting and cleaning the rollers.

16. The portable pill crushing device according to claim 15, wherein said pressure plate is rotatable about a first axis from said closed position to said open position and is further rotatable about said first axis to move a second surface of the pressure plate into close proximity to an outer surface of the housing for engaging and crushing pills between the pressure plate and the housing in a manual pre-crushing operation.

17. The portable pill crushing device according to claim 15, wherein said base equipped with a vacuum lock system which is operable to anchor the crushing device to a smooth surface using a vacuum created between the base and the smooth surface.

18. The portable pill crushing device according to claim 15, further comprising a plastic enclosure for encasing a pill to be crushed to prevent direct contact of the pill with the rollers and the pressure plate to avoid contamination.

* * * * *